US010053933B2

(12) United States Patent
Duhon

(10) Patent No.: US 10,053,933 B2
(45) Date of Patent: Aug. 21, 2018

(54) ROTARY SLIP BOWL AND SYSTEM

(71) Applicant: ADVANCED TOOL AND SUPPLY, LLC, Broussard, LA (US)

(72) Inventor: Bryan Duhon, Church Point, LA (US)

(73) Assignee: Advanced Tool and Supply, LLC, Broussard, LA (US)

( * ) Notice: Subject to any disclaimer, the term of this patent is extended or adjusted under 35 U.S.C. 154(b) by 94 days.

(21) Appl. No.: 15/095,312

(22) Filed: Apr. 11, 2016

(65) Prior Publication Data

US 2016/0305202 A1 Oct. 20, 2016

Related U.S. Application Data

(60) Provisional application No. 62/149,227, filed on Apr. 17, 2015.

(51) Int. Cl.
*E21B 19/10* (2006.01)

(52) U.S. Cl.
CPC ..... *E21B 19/10* (2013.01)

(58) Field of Classification Search
CPC ..... E21B 19/10
See application file for complete search history.

(56) References Cited

U.S. PATENT DOCUMENTS 2,890,513 A * 6/1959 Lane ..... E21B 19/10 188/67
2004/0079533 A1* 4/2004 Buytaert ..... E21B 19/10 166/380
2006/0108122 A1* 5/2006 Buytaert ..... E21B 17/026 166/379
2014/0119821 A1* 5/2014 Bertelsen ..... B23C 3/28 403/345

OTHER PUBLICATIONS

Ramey Martin Energy Tools, Product Catalog, RMET Insert Bowls, p. 75-76, 2014.

* cited by examiner

*Primary Examiner* — Giovanna C. Wright
*Assistant Examiner* — Dany E Akakpo
(74) *Attorney, Agent, or Firm* — Jones Walker LLP

(57) ABSTRACT

A rotary slip bowl includes a tubular body having a central bore with an internal surface. The internal surface includes a tapered profile extending from a top surface to a generally straight profile. The rotary slip bowl also includes one or more umbilical grooves in the internal surface, wherein each umbilical groove is dimensioned to partially house an umbilical line. A rotary slip system includes the rotary slip bowl and a rotary slip set configured to be partially housed within the central bore. The rotary slip set includes two or more slip segments separated by spaces. One of the spaces is aligned with each umbilical groove of the rotary slip bowl. A handle is affixed to an upper end of a slip segment with the handle positioned adjacent to one of the spaces. The rotary slip system may further include a carrier for transporting the rotary slip bowl.

15 Claims, 7 Drawing Sheets

ROTARY SLIP BOWL AND SYSTEM

CROSS-REFERENCE TO RELATED APPLICATION

This application claims the benefit of and priority to U.S. Provisional Patent Application No. 62/149,227, filed on Apr. 17, 2015.

BACKGROUND OF THE INVENTION

Rotary slip bowls are placed within rotary tables over wellbores. Rotary slip bowls house rotary slips, which are used to grip tubulars suspended by the rotary tables over the wellbores. FIGS. 1 and 2 illustrate a prior art rotary slip bowl. Body 10 includes central bore 12 having inner surface 14. Inner surface 14 may include tapered profile 16 extending to straight profile 18. Tapered profile 16 may include one or more lifting bores 19. Straight profile 18 may include one or more wear grooves 20. A set of rotary slips may be housed within central bore 12, and a tubular string may be suspended from the rotary slips. As the tubular string is rotated relative to the rotary slip bowl, wear may occur on straight profile 18. Accordingly, wear grooves 20 may be used to detect and measure such wear on straight profile 18. Body 10 may be lifted and moved on a job location using a lifting sling, i.e., by engaging lifting bores 19 with hooks of the lifting sling.

DETAILED DESCRIPTION OF THE PREFERRED EMBODIMENTS

Figure 1:
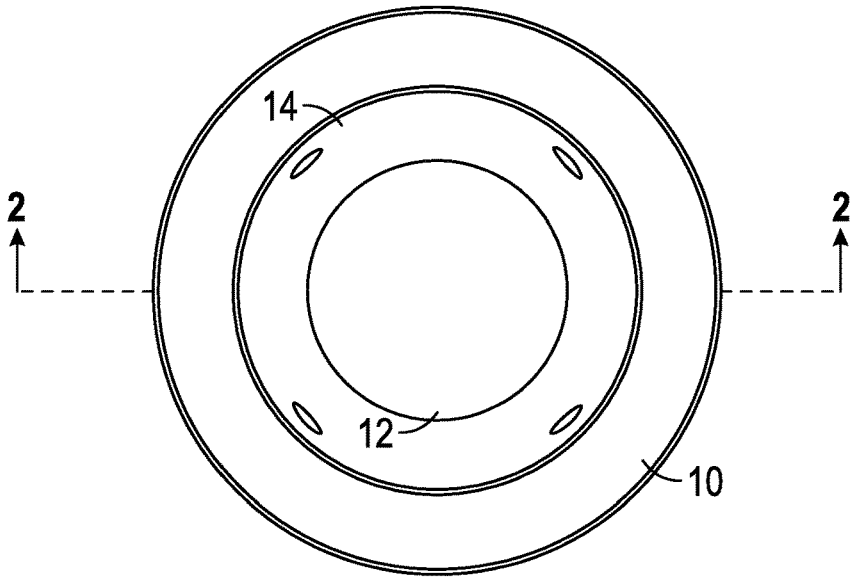
FIG. 1 (Prior Art)
FIG. 1 is a top view of a prior art rotary slip bowl.
Figure 2:
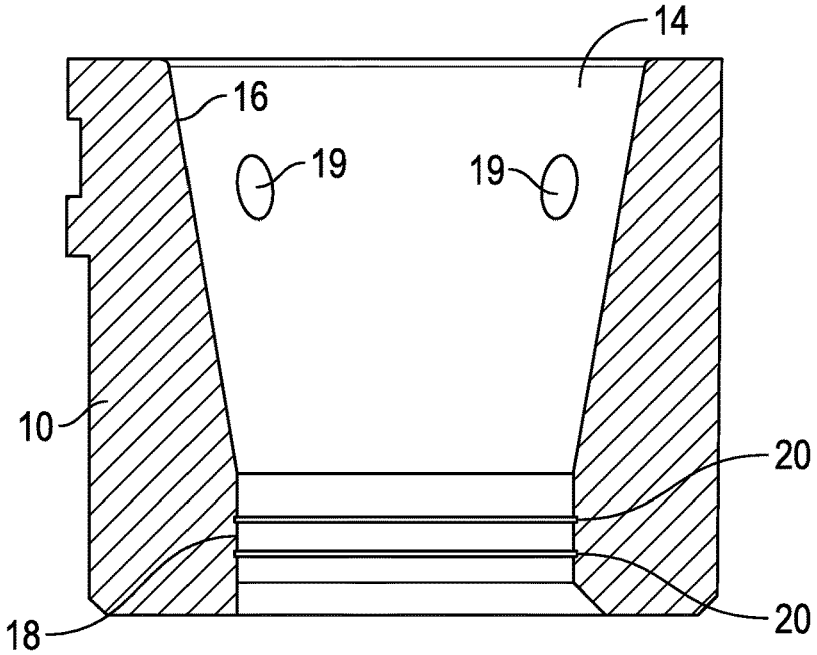
FIG. 2 (Prior Art)
FIG. 2 is a cross-sectional view of the prior art rotary slip bowl taken from line 2-2 in FIG. 1.
Figure 3:
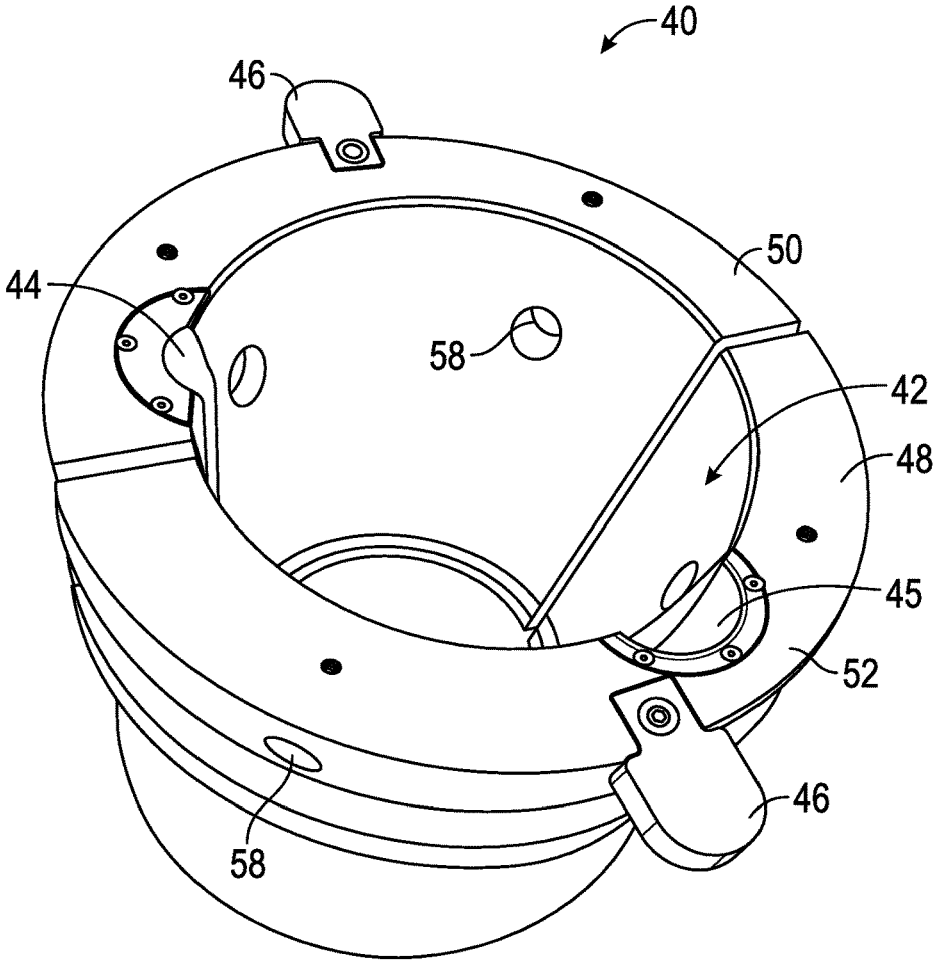
FIG. 3 is a perspective view of a rotary slip bowl disclosed herein.
Figure 4:
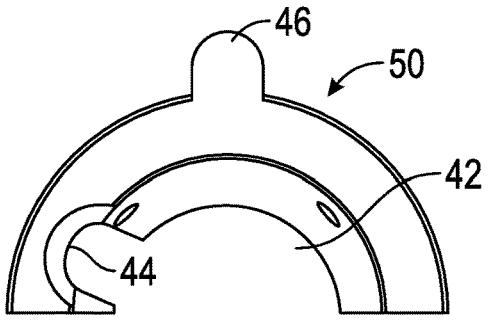
FIG. 4 is a top view of a first segment of the rotary slip bowl.
Figure 5:
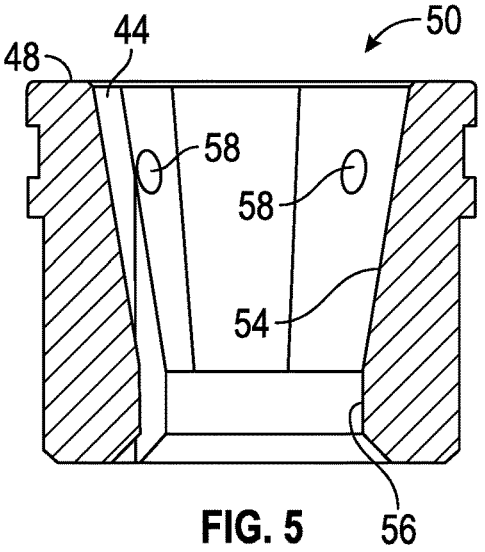
FIG. 5 is a front view of the first segment.
Figure 6:
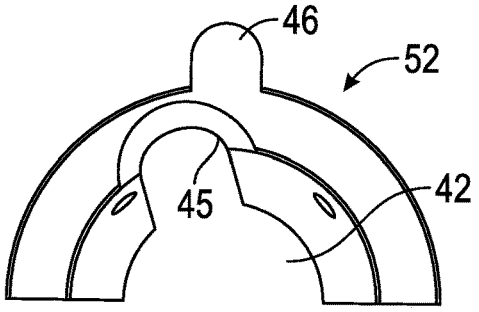
FIG. 6 is a top view of a second segment of the rotary slip bowl.
Figure 7:
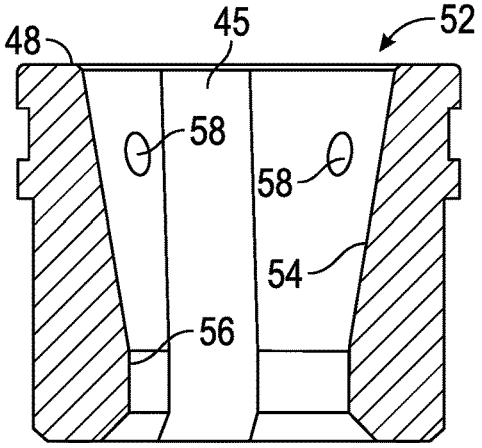
FIG. 7 is a front view of the second segment.

With reference to FIG. 3, rotary slip bowl 40 is formed of a tubular body with central bore 42. Rotary slip bowl 40 includes umbilical grooves 44 and 45, also referred to as longitudinal grooves, in the internal surface of central bore 42. Umbilical grooves 44, 45 may each have a semi-cylindrical shape and may be dimensioned to partially house an umbilical line, as further described below. Umbilical grooves 44, 45 may each include a lining forming an internal surface of umbilical grooves 44, 45. For example, the lining may be formed of a plastic (e.g., an ultra high molecular weight polyethylene) to provide a smoother internal surface for umbilical grooves 44, 45. Rotary slip bowl 40 may also include projections 46 extending from top surface 48 of rotary slip bowl 40. Each of projections 46 may be configured to engage a recess in a rotary table in order to rotationally align rotary slip bowl 40 in the rotary table. Projections 46 may also be referred to as rotary table projections 46.

Referring to FIGS. 3-7, rotary slip bowl 40 may include first segment 50 and second segment 52. Umbilical groove 44 may be positioned on first segment 50, and umbilical groove 45 may be positioned on second segment 52. Umbilical grooves 44, 45 may each have a diameter between about 3 inches and 5 inches. For example, umbilical groove 44 may have a diameter of about 3¼ inches, and umbilical groove 45 may have a diameter of about 4⅜ inches. Internal surface of central bore 42 may include tapered profile 54 extending from top surface 48 to generally straight profile 56. Umbilical grooves 44, 45 may extend along the entire length of rotary slip bowl 40, i.e., through tapered profile 54 and generally straight profile 56. Rotary slip bowl 40 may further include one or more lifting bores 58 through tapered profile 54.

Figure 8:
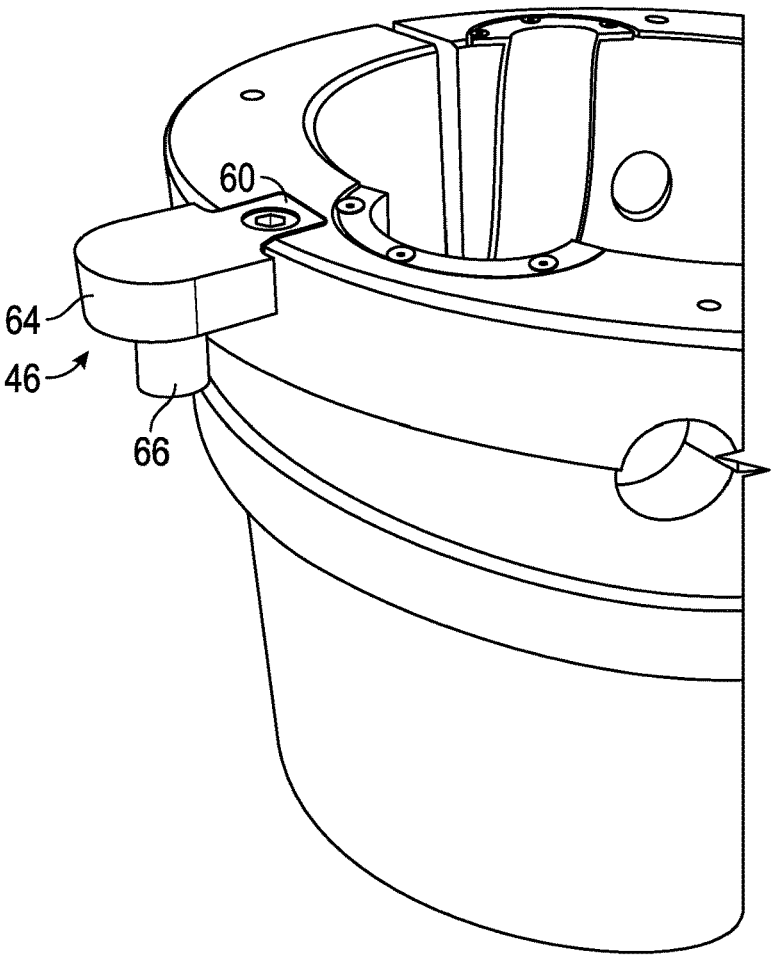
FIG. 8 is a perspective view of a rotary table projection of the rotary slip bowl.
Figure 9:
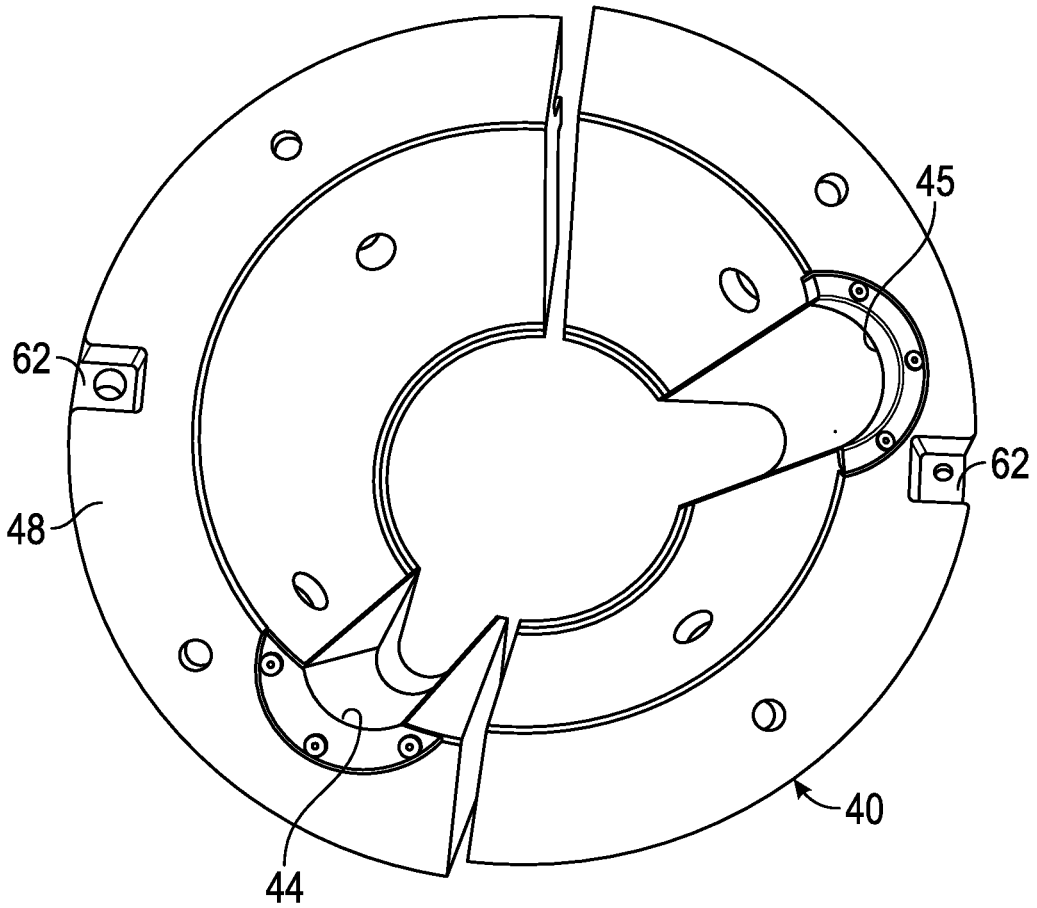
FIG. 9 is a top view of the rotary slip bowl with the rotary table projections removed.

In one embodiment, projections 46 are removable. FIGS. 3, 8, and 9 show rotary slip bowl 40 including removable projections 46. In other embodiments, such as those shown in FIGS. 4-7, projections 46 are integrally formed with the tubular body of rotary slip bowl 40.

Referring now to FIGS. 8 and 9, each removable projection 46 may include body portion 60 dimensioned to fit into recess 62 in top surface 48 of rotary slip bowl 40. Removable projection 46 may be secured to recess 62 with a bolt that engages a bore through body portion 60 of removable projection 46 and a bore in a lower surface of recess 62. Each removable projection 46 may also include key portion 64 extending from body portion 60. Key portion 64 may be configured to engage a recess in a rotary table into which rotary slip bowl 40 is placed. For example, key portion 64 may include vertical extension 66 dimensioned to engage a vertical recess in the rotary table.

Figure 10:
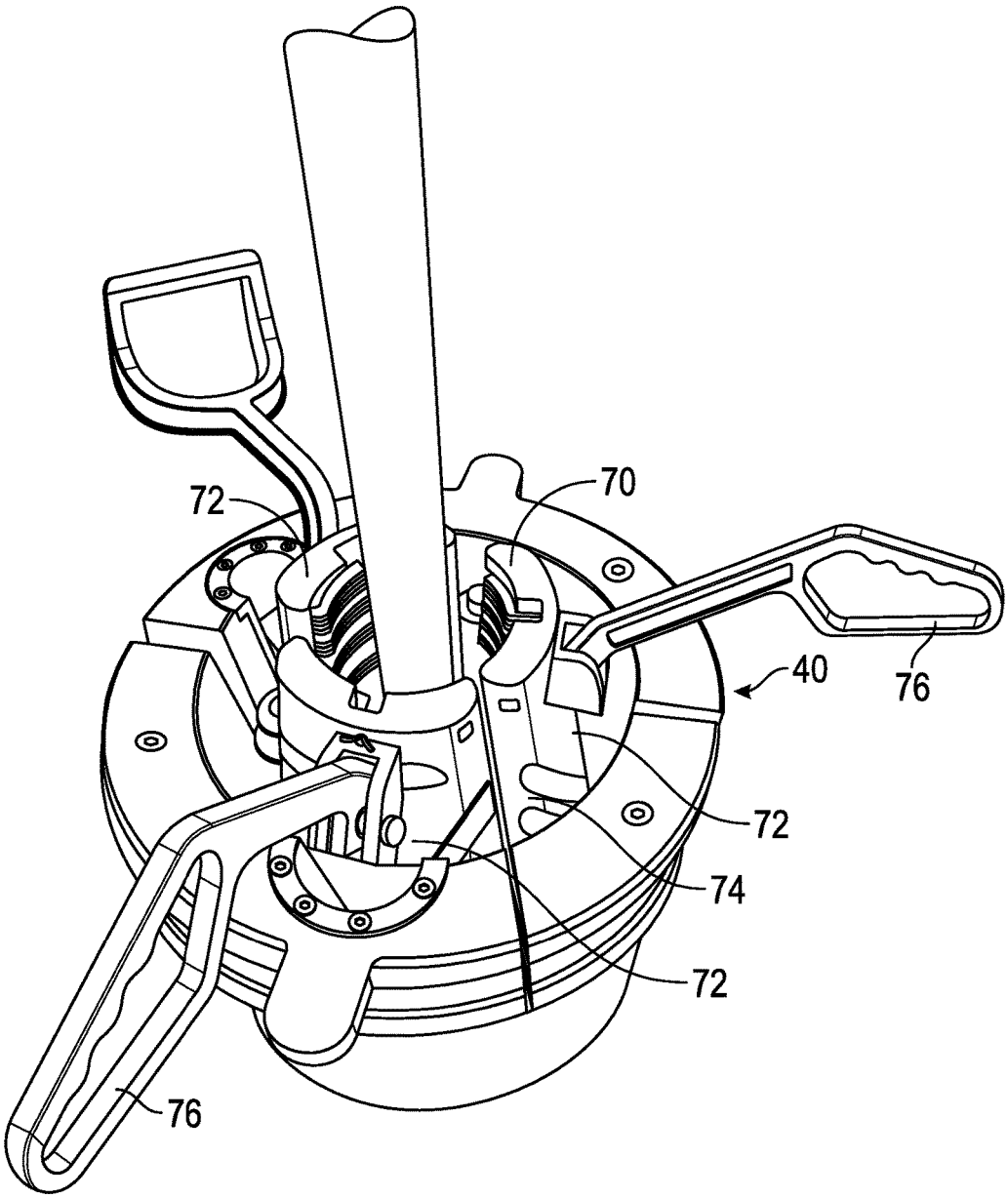
FIG. 10 is perspective view of an alternate rotary slip bowl disclosed herein housing a prior art rotary slip set.
Figure 11:
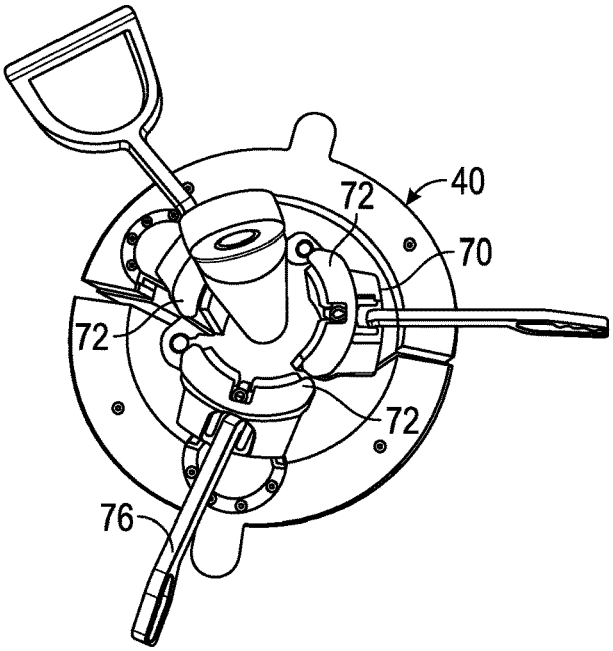
FIG. 11 is a top view of the alternate rotary slip bowl disclosed herein housing a prior art rotary slip set.

Rotary slip bowl 40 is configured to hold a rotary slip set. For example, rotary slip bowl 40 may hold a prior art rotary slip set 70 as shown in FIGS. 10 and 11. Rotary slip set 70 includes two or more slips 72, with adjacent slips separated by spaces 74. However, because of the positioning of umbilical grooves 44 and 45, handles 76 of rotary slip set 70 may obstruct the path of an umbilical line partially housed within umbilical grooves 44 and 45.

Figure 12:
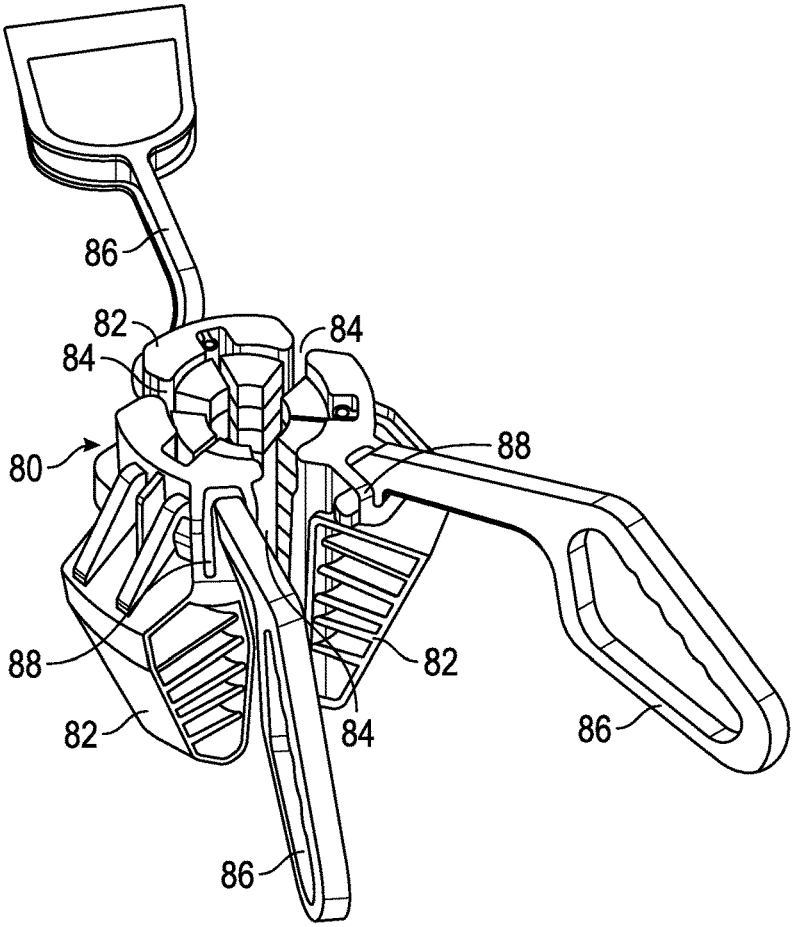
FIG. 12 is a perspective view of a rotary slip set disclosed herein.

FIG. 12 illustrates improved rotary slip set 80 including two or more slips 82 separated by spaces 84. For example, rotary slip set 80 may include three slips 82. Rotary slip set 80 may be similar to a DU long rotary slip set. Handles 86 may be pivotally attached to receptacles 88 on the upper end of each slip 82. Receptacle 88 on one of the slips 82 may be disposed at the center of the slip. Receptacles 88 on the other two slips 82 may be disposed adjacent to space 84 separating these two slips 82. In this way, rotary slip set 80 provides additional clearance for umbilical lines partially housed within umbilical grooves 44, 45 when rotary slip set 80 is positioned within rotary slip bowl 40.

Rotary slip set 80 may be placed in central bore 42 of rotary slip bowl 40 with umbilical grooves 44, 45 aligned with spaces 84 between slips 82. For example, where umbilical grooves 44, 45 are separated by less than 180 degrees, rotary slip set 80 may be positioned in rotary slip bowl 40 such that the slip 82 with the centered handle 86 is positioned between umbilical grooves 44, 45 to provide additional clearance with the other two handles 86 positioned further from umbilical grooves 44, 45. An umbilical line may be run through central bore 42 of rotary slip bowl 40, with the umbilical line partially housed within umbilical groove 44 or 45 and through spaces 84 between slips 82. In this way, rotary slip bowl 40 allows umbilical lines to be run along with tubulars into a wellbore through a rotary table.

Figure 13:
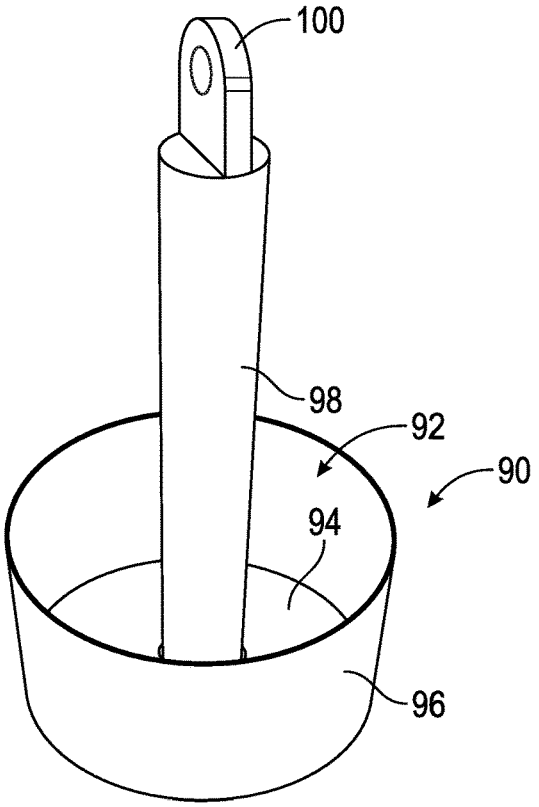
FIG. 13 is a perspective view of a carrier for the rotary slip bowl.
Figure 14:
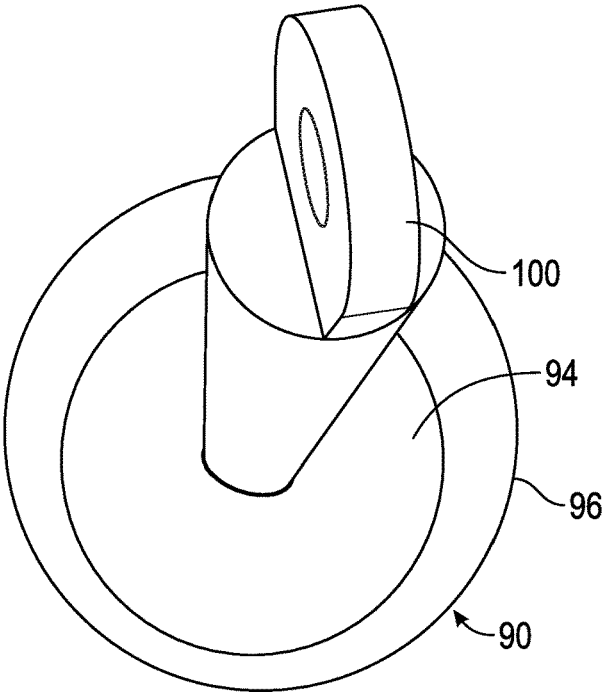
FIG. 14 is a top view of the carrier.

Rotary slip bowl 40 may be lifted and transported using a lifting sling by engaging lifting bores 58 with hooks of the lifting sling. Alternatively, rotary slip bowl 40 may be transported using carrier 90 shown in FIGS. 13 and 14. Carrier 90 may include tubular cavity 92 formed by circular floor 94 and side wall 96 extending from the outer edge of floor 94. Carrier 90 may also include support 98 extending from a central area of floor 94. Lift eye 100 may be disposed at the upper end of support 98. First and second segments 50 and 52 of rotary slip bowl 40 may be lifted (such as with hooks of a lifting sling through lifting bores 58 of segments 50, 52) and placed into tubular cavity 92 of carrier 90. Carrier 90 may then be lifted and transported, such as by engaging lift eye 100 with a crane or other lifting apparatus. Carrier 90 provides a safer method for transportation of first and second segments 50, 52 of rotary slip bowl 40.

Each of the described components may be formed of steel. For example, the tubular body of rotary slip bowl 40 may be formed of 41/45 steel, rotary slip set 80 may be formed of 41/45 heat treated steel, and carrier 90 may be formed of schedule 40 steel pipe.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

The invention claimed is:

1. A rotary slip bowl comprising:

a tubular body configured for placement within a rotary table, the tubular body including a central bore defined by an internal surface having a tapered profile extending to a generally straight profile, the internal surface of the tubular body configured to receive a rotary slip set;

one or more umbilical grooves in the internal surface of the tubular body, wherein each umbilical groove is dimensioned to partially house an umbilical line;

one or more projections extending from a top surface of the tubular body, wherein each of the one or more projections is configured to engage a recess in the rotary table, wherein each of the one or more projections is detachable from the tubular body, wherein each of the one or more projections includes a body portion and a key portion, and wherein the body portion is dimensioned to attach to a recess in the top surface of the tubular body and the key portion is configured to engage the recess in the rotary table.

2. The rotary slip bowl of claim 1, further comprising a lining forming an internal surface of each of the one or more umbilical grooves.

3. The rotary slip bowl of claim 2, wherein the lining includes polyethylene.

4. The rotary slip bowl of claim 1, wherein each of the one or more umbilical grooves has a semi-cylindrical shape.

5. The rotary slip bowl of claim 4, wherein each of the one or more umbilical grooves has a diameter of between 3 inches and 5 inches.

6. The rotary slip bowl of claim 4, wherein the one or more umbilical grooves comprises a first umbilical groove having a diameter of about 3¼ inches, and a second umbilical groove having a diameter of about 4⅜ inches.

7. The rotary slip bowl of claim 4, wherein the tubular body is formed of a first segment and a second segment, and wherein the one or more umbilical grooves comprises a first umbilical groove disposed on the first segment and a second umbilical groove disposed on the second segment.

8. The rotary slip bowl of claim 1, wherein the tubular body is formed of a first segment and a second segment, wherein the one or more projections comprises a first projection and a second projection, and wherein the first segment includes the first projection and the second segment includes the second projection.

9. The rotary slip bowl of claim 1, wherein a bolt is disposed through a bore in the body portion of each of the one or more projections and through a bore in the recess in the top surface of the tubular body to secure each of the one or more projections to the tubular body.

10. The rotary slip bowl of claim 1, wherein the key portion of each of the one or more projections includes a vertically extending portion dimensioned to engage a vertical recess in the rotary table.

11. A rotary slip bowl comprising:

a tubular body configured for placement within a rotary table, the tubular body including a first segment and a second segment, wherein the first segment and the second segment together form a central bore defined by an internal surface having a tapered profile extending from a top surface to a generally straight profile, the internal surface of the tubular body configured to receive a rotary slip set;

one or more umbilical grooves in the internal surface of the tubular body, wherein each of the one or more umbilical grooves is dimensioned to partially house an umbilical line; and one or more projections extending from the top surface of the tubular body, wherein each of the one or more projections is configured to engage a recess in the rotary table, wherein each of the one or more projections is detachable from the tubular body, wherein each of the one or more projections includes a body portion and a key portion, and wherein the body portion is dimensioned to attach to a recess in the top surface of the tubular body and the key portion is configured to engage the recess in the rotary table; and wherein the one or more umbilical grooves comprises a first umbilical groove and a second umbilical groove and the one or more projections comprises a first projection and a second projection, wherein the first segment includes the first umbilical groove and the first projection, and wherein the second segment includes the second umbilical groove and the second projection.

12. A rotary slip system comprising:

a rotary bowl configured for placement within a rotary table, the rotary bowl including a tubular body having a central bore defined by an internal surface having a tapered profile extending to a generally straight profile, wherein the rotary bowl further includes one or more umbilical grooves in the internal surface of the tubular body, wherein each of the one or more umbilical grooves is dimensioned to partially house an umbilical line; and a rotary slip set dimensioned to fit within the central bore of the tubular body of the rotary bowl, the rotary slip set including three or more slip segments, wherein adjacent slip segments are separated by a space, and wherein a first handle is affixed to an upper end of one of the three or more slip segments and is positioned adjacent to the space separating the adjacent slip segment; and a carrier including a tubular cavity dimensioned to receive the rotary bowl for transportation, wherein the tubular cavity includes a circular floor and a tubular side wall extending from an outer edge of the circular floor, and wherein the carrier further includes a support vertically extending from a central area of the floor and a lift eye disposed at an upper end of the support.

13. The rotary slip system of claim 12, wherein the three or more slip segments comprises a first slip segment, a second slip segment, and a third slip segment, wherein the rotary slip set include a second handle and a third handle, wherein the first handle is attached to a first receptacle on an upper end of the first slip segment, wherein the second handle is attached to a second receptacle on an upper end of the second slip segment, wherein the third handle is attached to a third receptacle on an upper end of the third slip segment; wherein the first receptacle is disposed on a central portion of the first slip segment; and wherein the second receptacle and the third receptacle are each disposed adjacent to the space between the second and third slip segments to provide clearance for the umbilical line to be partially housed within one of the one or more umbilical grooves.

14. The rotary slip system of claim 13, wherein the first handle is pivotally attached to the first receptacle, the second handle is pivotally attached to the second receptacle, and the third handle is pivotally attached to the third receptacle.

15. The rotary slip system of claim 12, wherein the tubular body includes a first segment and a second segment, wherein the one or more umbilical grooves comprises a first umbilical groove and a second umbilical groove, and wherein the internal surface of the first segment of the tubular body contains the first umbilical groove and the internal surface of the second segment of the tubular body contains the second umbilical groove.

* * * * *